US008758207B2

(12) United States Patent
Elbaz et al.

(10) Patent No.: US 8,758,207 B2
(45) Date of Patent: Jun. 24, 2014

(54) PROPRIOCEPTIVE/KINESTHETIC APPARATUS AND METHOD

(75) Inventors: Avi Elbaz, Dimona (IL); Amit Mor, Rehovot (IL)

(73) Assignee: APOS—Medical and Sports Technologies Ltd., Herzliya (IL)

( * ) Notice: Subject to any disclaimer, the term of this patent is extended or adjusted under 35 U.S.C. 154(b) by 155 days.

(21) Appl. No.: 12/825,684

(22) Filed: Jun. 29, 2010

(65) Prior Publication Data

US 2010/0325919 A1 Dec. 30, 2010

Related U.S. Application Data

(63) Continuation-in-part of application No. 12/636,800, filed on Dec. 14, 2009, which is a continuation-in-part of application No. 10/222,992, filed on Aug. 19, 2002, now Pat. No. 6,979,287.

(51) Int. Cl.

| | |
|---|---|
| ***A63B 23/00*** | (2006.01) |
| ***A63B 23/08*** | (2006.01) |
| ***A43B 13/00*** | (2006.01) |

(52) U.S. Cl.
USPC ..... 482/148; 36/25 R; 36/102; 482/79

(58) Field of Classification Search
USPC ..... 482/77, 79, 148; D2/847, 951, 952, D2/953, 954, 955, 956, 960; 36/15, 28, 29, 36/25 R, 30 R, 31, 32 R
See application file for complete search history.

(56) References Cited

U.S. PATENT DOCUMENTS

| | | | | |
|---|---|---|---|---|
| 1,529,421 | A | 3/1925 | Dowdell | |
| 1,736,576 | A | 11/1929 | Cable | |
| 2,303,744 | A | 12/1942 | Jacobs | |
| 3,082,549 | A * | 3/1963 | Dolceamore | 36/128 |
| 3,402,485 | A | 9/1968 | McMorrow | |
| 3,526,976 | A | 9/1970 | Jacobs | |
| 3,552,043 | A | 1/1971 | Moffa | |
| 3,782,011 | A | 1/1974 | Fisher | |
| 3,859,736 | A | 1/1975 | Hill et al. | |

(Continued)

FOREIGN PATENT DOCUMENTS

| | | |
|---|---|---|
| DE | 1907894 | 1/1965 |
| DE | 29902731 | 3/2000 |

(Continued)

OTHER PUBLICATIONS

ISR of WO 2004/016321 (or PCT/IL2003/000668), mailed on Mar. 26, 2004 (8 pages).

(Continued)

*Primary Examiner* — Stephen Crow
(74) *Attorney, Agent, or Firm* — Roach Brown McCarthy & Gruber, P.C.; Kevin D. McCarthy

(57) ABSTRACT

Footwear includes a support member having an upper surface attachable to a foot, and two bulbous protuberances, a forward bulbous protuberance and rearward bulbous protuberance. Each of the protuberances has a curved outer contour, and protrudes from a lower surface of the support member on opposite sides of a latitudinal midline thereof, the latitudinal midline being halfway between a calcaneus support portion and a phalanges support portion of the support member. The forward bulbous protuberance is positioned medially offset with respect to a longitudinal centerline.

5 Claims, 15 Drawing Sheets

(56) References Cited

U.S. PATENT DOCUMENTS

| | | | | |
|---|---|---|---|---|
| 3,916,538 | A | 11/1975 | Loseff | |
| 3,940,128 | A | 2/1976 | Ragone | |
| 4,030,213 | A | 6/1977 | Daswick | |
| 4,071,963 | A | 2/1978 | Fukuoka | |
| 4,241,523 | A | 12/1980 | Daswick | |
| 4,348,821 | A | 9/1982 | Daswick | |
| RE31,173 | E | 3/1983 | Daswick | |
| 4,586,706 | A | 5/1986 | Chen | |
| 4,629,181 | A | 12/1986 | Krive | |
| 4,653,748 | A | 3/1987 | Seel et al. | |
| 4,660,826 | A | 4/1987 | Lee | |
| 4,739,986 | A | 4/1988 | Kucharik et al. | |
| 4,821,432 | A | 4/1989 | Reiber | |
| 4,892,090 | A | 1/1990 | Kaeser | |
| 5,035,418 | A | 7/1991 | Harabayashi | |
| 5,203,321 | A | 4/1993 | Donovan et al. | |
| 5,337,494 | A | 8/1994 | Ricker | |
| D357,347 | S * | 4/1995 | Leick | D2/951 |
| 5,518,476 | A | 5/1996 | McLeon | |
| 5,533,282 | A | 7/1996 | Kataoka et al. | |
| 5,549,527 | A | 8/1996 | Yu | |
| 5,584,787 | A | 12/1996 | Guidry | |
| 5,603,334 | A | 2/1997 | Sharp | |
| 5,643,145 | A | 7/1997 | Lo et al. | |
| 5,682,690 | A | 11/1997 | Chang | |
| 5,685,807 | A | 11/1997 | Tong et al. | |
| D394,343 | S * | 5/1998 | Marshall et al. | D2/960 |
| D394,541 | S * | 5/1998 | Burgess | D2/954 |
| 5,848,954 | A | 12/1998 | Stearns et al. | |
| 5,897,464 | A | 4/1999 | McLeod | |
| 5,902,214 | A | 5/1999 | Makikawa et al. | |
| D412,393 | S * | 8/1999 | Aquino | D2/954 |
| 6,019,712 | A | 2/2000 | Duncan | |
| 6,063,046 | A | 5/2000 | Allum | |
| 6,102,832 | A | 8/2000 | Tani | |
| 6,126,577 | A | 10/2000 | Chang | |
| 6,176,817 | B1 | 1/2001 | Carey et al. | |
| 6,277,057 | B1 | 8/2001 | Hayden | |
| 6,283,897 | B1 | 9/2001 | Patton | |
| D448,920 | S * | 10/2001 | Montross et al. | D2/954 |
| 6,311,416 | B1 | 11/2001 | Cohen | |
| 6,315,786 | B1 | 11/2001 | Smuckler | |
| 6,393,735 | B1 | 5/2002 | Berggren | |
| 6,511,404 | B2 | 1/2003 | Tu | |
| 6,551,225 | B1 | 4/2003 | Romero | |
| 6,652,432 | B2 | 11/2003 | Smith | |
| D482,851 | S * | 12/2003 | McClaskie | D2/956 |
| 6,692,419 | B2 | 2/2004 | Chen | |
| D488,915 | S * | 4/2004 | Girbaud et al. | D2/955 |
| 6,792,703 | B2 | 9/2004 | Cohen | |
| 6,793,609 | B1 | 9/2004 | Fan | |
| 6,796,056 | B2 * | 9/2004 | Swigart | 36/29 |
| 6,811,523 | B1 | 11/2004 | Timmer | |
| 6,979,287 | B2 | 12/2005 | Elbaz et al. | |
| 7,004,895 | B2 | 2/2006 | Perry et al. | |
| 7,081,070 | B1 | 7/2006 | Washington et al. | |
| 7,101,330 | B2 | 9/2006 | Elbaz et al. | |
| D648,517 | S * | 11/2011 | Vestuti et al. | D2/955 |
| 8,079,159 | B1 * | 12/2011 | Rosa | 36/25 R |
| 2002/0026730 | A1 | 3/2002 | Whatley | |
| 2002/0092201 | A1 | 7/2002 | Kraeuter et al. | |
| 2003/0148865 | A1 | 8/2003 | Handshoe | |
| 2004/0053751 | A1 | 3/2004 | Pizolato | |
| 2009/0113760 | A1 * | 5/2009 | Dominguez | 36/102 |
| 2010/0251565 | A1 * | 10/2010 | Litchfield et al. | 36/28 |
| 2011/0072684 | A1 * | 3/2011 | Stubblefield | 36/29 |

FOREIGN PATENT DOCUMENTS

| | | |
|---|---|---|
| DE | 10133863 | 2/2003 |
| EP | 925809 | 6/1999 |
| FR | 1128009 | 1/1957 |
| JP | 61119282 | 6/1986 |
| JP | 08000763 | 1/1996 |
| JP | 9308706 | 12/1997 |
| JP | 2000084035 | 3/2000 |
| NL | 8502659 | 4/1987 |
| WO | WO 98/31245 | 7/1998 |
| WO | WO 01/37693 | 5/2001 |
| WO | WO 02/37995 | 5/2002 |
| WO | 2004016321 A2 | 2/2004 |

OTHER PUBLICATIONS

The Gait Cycle as found at http://www.upstate.edu/cdb/education/grossanat/limbs6.shtml (2013).

* cited by examiner

PROPRIOCEPTIVE/KINESTHETIC APPARATUS AND METHOD

RELATED APPLICATIONS

The present invention is a continuation-in-part of U.S. patent application Ser. No. 12/636,800, filed Dec. 14, 2009, which is a continuation-in-part of U.S. patent application Ser. No. 10/222,992, filed Aug. 19, 2002 now U.S. Pat. No. 6,979,287, the contents of which all are incorporated herein by reference in their entirety.

FIELD OF THE INVENTION

The present invention relates generally to apparatus for training, developing and enhancing proprioceptive and kinesthetic skills, neuromuscular control and core stability.

BACKGROUND OF THE INVENTION

Proprioception refers to the ability to know where a body part is located in space and to recognize movements of body parts (such as fingers and toes, feet and hands, legs and arms). Kinesthesia is a related term, and refers to the sensation by which position, weight, muscle tension and movement are perceived. In some of the medical literature, proprioception refers to the conscious and unconscious appreciation of joint position, while kinesthesia refers to the sensation of joint velocity and acceleration. Proprioception is often used interchangeably with kinesthesia, and herein as well, the terms will be used interchangeably. (Throughout the specification and claims, the term "proprioception" will be used to encompass proprioception, kinesthesia, core stability and the like.)

The neuromuscular control system of the body integrates peripheral sensations relative to joint loads and processes these signals into coordinated motor responses. This muscle activity serves to protect joint structures from excessive strain.

Certain mechanoreceptors are present throughout the soft tissues of the musculoskeletal system which interact with the central nervous system and coordinate body movements, postural alignment, and balance. Mechanoreceptors are located in the muscles, tendons, ligaments, joint capsules and the skin. These nerve fibers provide information to the brain regarding the status and function of the musculoskeletal system. The mechanoreceptors send electrical signals along peripheral nerves to the spinal cord. The electrical signals travel via the spinal cord to the brain where the signals are interpreted to recognize movements of body parts, muscle tension, movement and the like.

Some examples of mechanoreceptors for controlling the muscular system include muscle spindles. Muscle spindles are found interspersed within the contractile fibers of skeletal muscles, with the highest concentration in the central portion of each muscle. Muscle spindle fibers respond to changes in the length of muscles. These nerve endings provide the central nervous system information used to maintain muscle tone and the correct muscle tension on opposite sides of each joint.

Fibrous tissues that surround and protect most joints generally contain a variety of sensory nerve endings for proprioception and kinesthesia. The input from these sensory nerve endings provides the central nervous system information regarding the location, stretch, compression, tension, acceleration, and rotation of the joint.

The foot is the anatomical region that contains the second largest number of proprioceptive or kinesthetic sensory receptors in the body (the spine has the most).

Proprioceptive and kinesthetic exercises and exercise devices are well known for improving agility, balance and coordination, and for rehabilitation of persons whose proprioceptive ability has been impaired, such as after accidents or illness. One such class of exercise devices includes tilt boards, wherein a patient stands on a board or similar platform that has a ball mounted underneath. The board does not lie horizontal due to the presence of the ball, and this challenges the ability of the patient to balance and perform maneuvers on the platform. Repeated exercises on the tilt board may be used to develop or rehabilitate the proprioception and neuromuscular control of the patient, as well as strengthen muscles, tendons and connective tissues in the foot area.

Other known proprioceptive and kinesthetic exercise devices include a shoe with a single ball mounted underneath the sole of the shoe. The shoe with the ball is used similar to the tilt board. Another kind of shoe has a rod mounted underneath the sole of the shoe, used for strengthening dorsiflexor muscles.

Yet another proprioceptive and kinesthetic exercise device is described in U.S. Pat. No. 6,283,897 to Patton. This device consists of one or more pegs protruding upwards from a baseboard. The pegs have a rounded top and sit in concave depressions (divots) in the bottom of an overshoe shaped like a sandal. Specifically, the bottom of the shoe's sole has three concave, hemisphere-shaped divots, with one located within the heel portion, one directly underneath the ball of the foot, and one located in the center. Elastomeric bands may support the user's foot as the user turns his foot and/or hips to develop the strength, range of motion, and proprioception of the ankle and hips.

SUMMARY OF THE INVENTION

There is thus provided, according to embodiments of the present invention, there is provided footwear that includes a support member having an upper surface attachable to a foot, and two bulbous protuberances, a forward bulbous protuberance and rearward bulbous protuberance. Each of the protuberances has a curved outer contour, and protrudes from a lower surface of the support member on opposite sides of a latitudinal midline. The latitudinal midline is halfway between a calcaneus support portion and a phalanges support portion of the support member. The forward bulbous protuberance is positioned medially offset with respect to a longitudinal centerline and the rearward bulbous protuberance is positioned laterally offset with respect to the longitudinal centerline.

Furthermore, according to embodiments of the present invention, the longitudinal centerline is defined as a longitudinal straight line connecting middles of the short sides of a rectangle which delimits a contour of the support member.

Furthermore, according to embodiments of the present invention, the contour is a contour of a foothold confined by an upper part of the footwear.

Furthermore, according to embodiments of the present invention, the contour is an outermost contour of the footwear.

Furthermore, according to embodiments of the present invention, the contour is the contour of a bottom surface of a sole of the footwear.

Furthermore, according to embodiments of the present invention, the height of the forward bulbous protuberance is greater than the height of the rearward bulbous protuberance.

Furthermore, according to embodiments of the present invention, the height of the rearward bulbous protuberance is greater than the height of the forward bulbous protuberance.

Furthermore, according to embodiments of the present invention, there is provided footwear that includes a support member having an upper surface attachable to a foot, and two bulbous protuberances, a forward bulbous protuberance and rearward bulbous protuberance. Each of the protuberances has a curved outer contour, and protrudes from a lower surface of the support member on opposite sides of a latitudinal midline. The forward bulbous protuberance is positioned laterally offset with respect to a longitudinal centerline and the rearward bulbous protuberance is positioned medially offset with respect to the longitudinal centerline.

Furthermore, according to embodiments of the present invention, there is provided footwear that includes a support member having an upper surface attachable to a foot, and two bulbous protuberances, a forward bulbous protuberance and rearward bulbous protuberance. Each of the protuberances has a curved outer contour, and protrudes from a lower surface of the support member on opposite sides of a latitudinal midline. The height of the forward bulbous protuberance is greater than the height of the rearward bulbous protuberance.

Furthermore, according to embodiments of the present invention, there is provided footwear that includes a support member having an upper surface attachable to a foot, and two bulbous protuberances, a forward bulbous protuberance and rearward bulbous protuberance. Each of the protuberances has a curved outer contour, and protrudes from a lower surface of the support member on opposite sides of a latitudinal midline. The height of the rearward bulbous protuberance is greater than the height of the forward bulbous protuberance.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
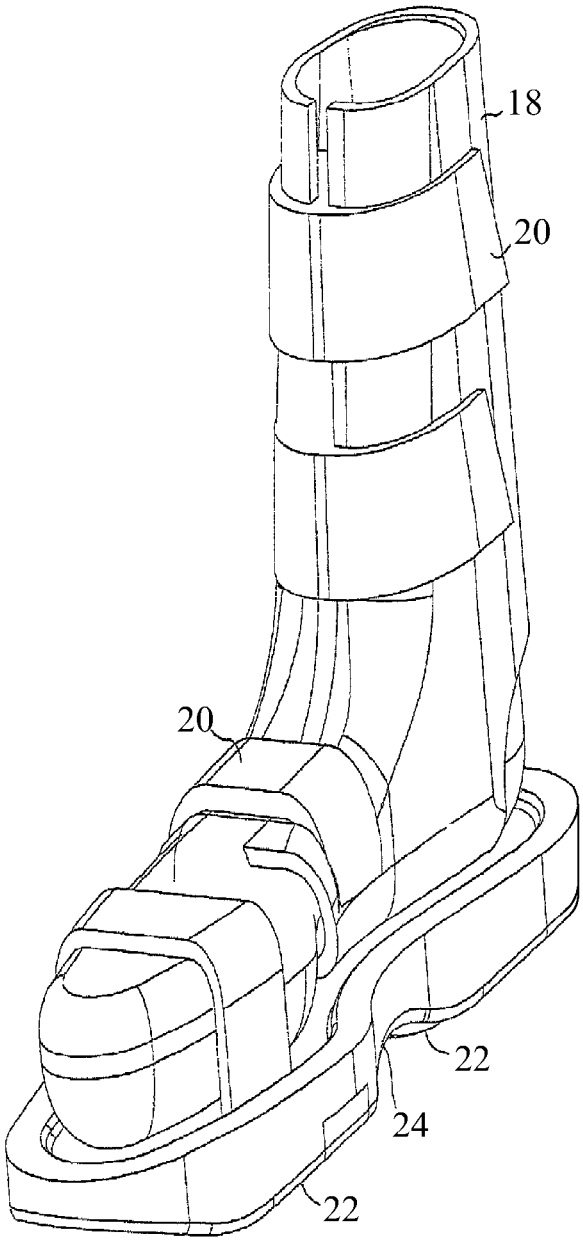
FIG. 1 is a simplified pictorial illustration of footwear constructed and operative in accordance with an embodiment of the present invention.

Reference is now made to FIGS. 1-4, which illustrate footwear 10 constructed and operative in accordance with an embodiment of the present invention. Footwear 10 may be supplied as one or more pairs of shoe-like devices, or alternatively, as just one of the shoe-like devices.

Footwear 10 preferably comprises a support member 12 having a periphery in a shape of a shoe sole with an upper surface 14. In the illustrated embodiment, the upper surface 14 is indented with a peripheral ridge 16, but it is appreciated that other configurations of upper surface 14 are within the scope of the invention. Footwear 10 may be attached to a foot of a user (not shown) by means of a boot 18 and/or fasteners 20, such as but not limited to, VELCRO straps, buckles, shoe laces, and the like. Boot 18 may be fashioned for attachment to the user's foot with or without fasteners 20. Similarly, fasteners 20 may be used to attach footwear 10 to the user's foot without boot 18.

Two bulbous protuberances 22 may protrude from a lower surface 24 of support member 12. Alternatively, bulbous protuberances 22 may protrude from the upper surface 14 of support member 12. Each protuberance 22 may have a curved outer contour 26. The cross-section of the contour 26, that is, either the cross-section taken with respect to a longitudinal axis 28 (FIG. 4) of support member 12 (corresponding to the shape seen in FIG. 2) or the cross-section taken with respect to a latitudinal axis 30 (FIG. 4) of support member 12 (corresponding to the shape seen in FIG. 3), or any other cross-section, may have any curvilinear shape. For example, the contours 26 may have the shape of a conic section, that is, the shape of a circle, ellipse, parabola or hyperbola. The various cross-sections of the contours 26 of protuberance 22 may be shaped identically or differently.

Figure 2:
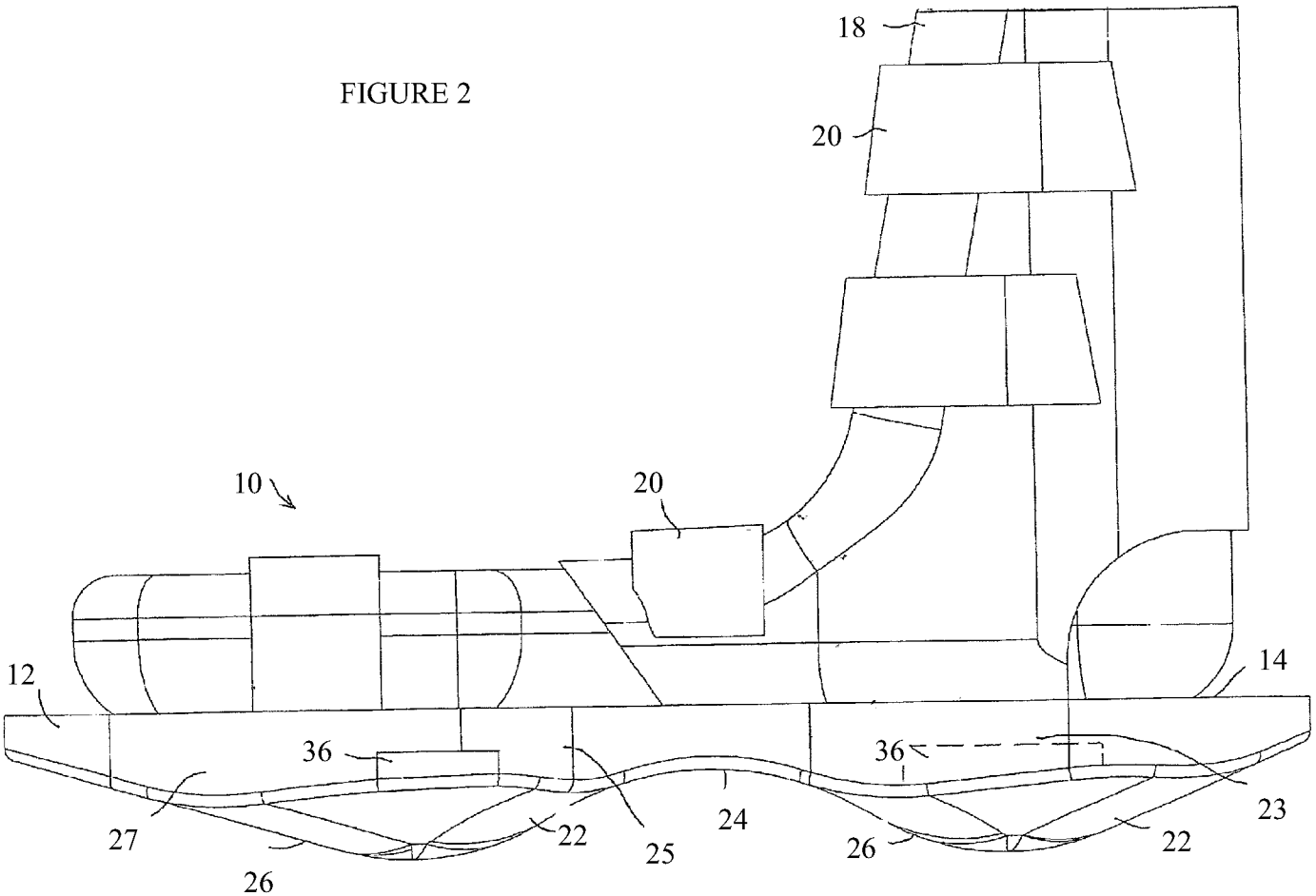
FIGS. 2 and 3 are simplified side-view and rear-view illustrations, respectively, of the footwear of FIG. 1.
Figure 4:
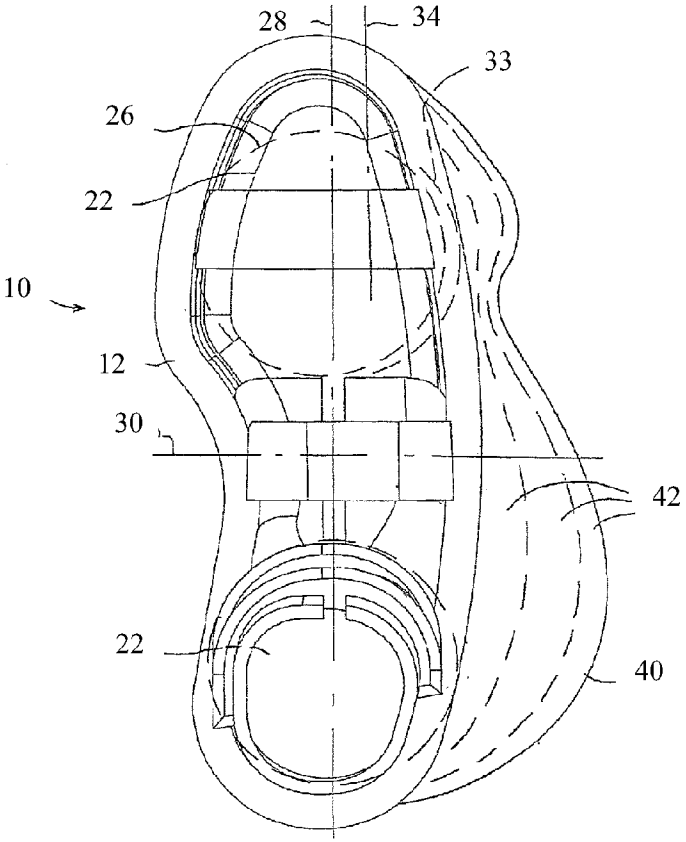
FIG. 4 is a simplified top-view illustration of the footwear of FIG. 1, showing further features of other embodiments of the present invention.

As seen clearly in FIG. 2, one protuberance 22 may be positioned more posteriorly than the other protuberance 22. As seen in FIG. 4, the protuberances may be positioned on a common longitudinal axis of support member 12, such as the centerline 28 of support member 12, and on opposite sides of the latitudinal midline 30. As seen in FIG. 2, the rearward protuberance 22 may be positioned generally underneath a calcaneus (heel, ankle) support portion 23 of support member 12, while the forward protuberance 22 may be positioned generally underneath a metatarsals support portion 25 and/or phalanges support portion 27 of support member 12.

According to embodiments of the present invention, the longitudinal centerline is defined as a longitudinal straight line connecting middles of the short sides of a rectangle which delimits a contour of the support member.

Alternatively, as indicated by broken lines 33 in FIG. 4, one of the protuberances 22 (e.g., the forward one) may be aligned on a longitudinal axis 34 offset from centerline 28, and the rearward protuberance 22 may be positioned offset from axis 34, such as on the centerline 28. It is appreciated that the above are just some examples of positioning the protuberances 22, and many other possibilities exist within the scope of the invention.

The protuberances 22 may be constructed of any suitable material, such as but not limited to, elastomers or metal or a combination of materials, and may have different properties. For example, the protuberances may have different resilience or hardness, such as having different elasticity properties or Shore hardness. The protuberances 22 may protrude by different amounts from the lower surface 24 of support member 12.

In accordance with an embodiment of the present invention, one or more protuberances 22 may be slidingly mounted on support member 12. For example, protuberance 22 may be mounted on a track 36 (FIG. 2) formed in the lower surface 24 of support member 12, and may be selectively positioned anywhere along the track and fastened thereto. Track 36 may extend along a portion of the shoe sole or all along the length of the shoe sole. Alternatively or additionally, the amount of protrusion of protuberance 22 may be adjusted, such as by mounting protuberance 22 with a threaded fastener 38 (FIG. 3) to support member 12 and tightening or releasing threaded fastener 38.

Figure 3:
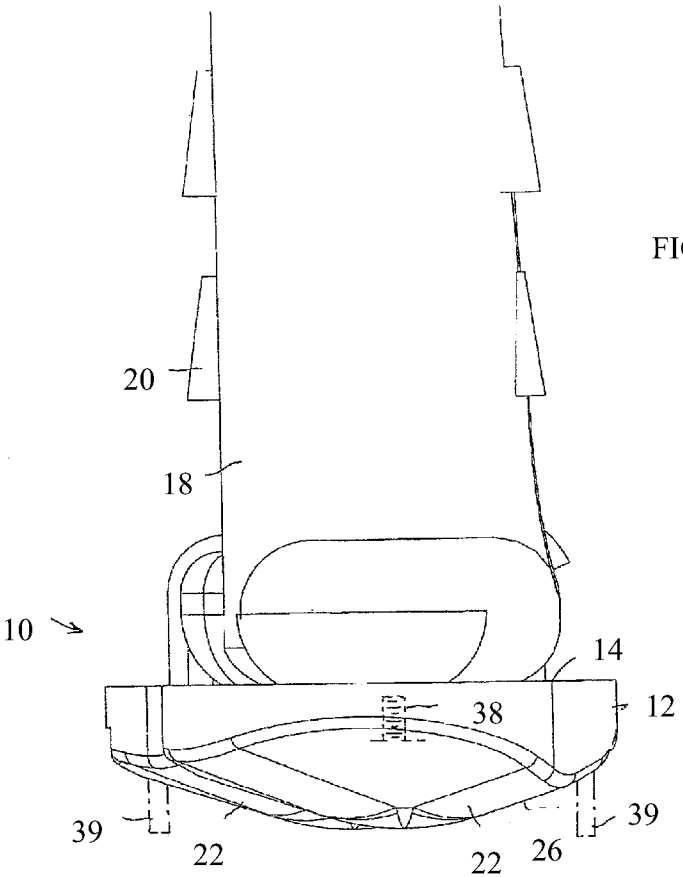

In accordance with an embodiment of the present invention, in addition to the bulbous protuberances 22, there further may be provided one or more non-bulbous protuberances 39, shown in FIG. 3. Protuberances 39 may be formed in the shape of a peg, stud, bolt, pin, dowel and the like, although the invention is not limited to these shapes. Protuberances 39 may be rigid or flexible. As with protuberances 22, the protuberances 39 may have different resilience or hardness, such as having different elasticity properties or Shore hardness, and they may protrude by different amounts from the lower surface 24 of support member 12. As above, the amount of protrusion of protuberances 39 may be adjusted. Protuberances 39 may be mounted at any place on the lower surface 24 of support member 12.

The features described above, such as the protuberances 22 being slidingly mounted on support member 12, may be implemented in the alternative embodiment wherein the bulbous protuberances 22 protrude from the upper surface 14 of support member 12. For example, footwear 10 may have a normal outer sole and have a sliding/shifting mechanism for the protuberances 22 inside the sole of footwear 10. The sliding/shifting mechanism may comprise, without limitation, a mechanism that floats in a viscous matrix (e.g., fluid in a chamber formed in the sole) or that is suspended by inner cables.

Reference is now made to FIG. 4. In accordance with an embodiment of the present invention, footwear 10 may comprise a flange 40 that extends outwards from the periphery of support member 12. In the illustrated embodiment, flange 40 extends sideways outwards from the periphery of support member 12, but it is appreciated that flange 40 may extend forwards or rearwards or in any other direction as well. Flange 40 may be provided on one side of footwear 10, as illustrated, or may be provided on both sides. Flange 40 may supplement the range of proprioceptive exercises possible with footwear 10, by providing an additional support surface during tilting and maneuvering with footwear 10.

Flange 40 may be constructed of any suitable material, such as but not limited to, elastomers or metal or a combination of materials, and may have portions 42 with different properties. For example, portions 42 may have different resilience or hardness, such as having different elasticity properties or Shore hardness. The portions 42 of flange 40 may have differently curved contours. Flange 40 may be adjustably attached to support member 12 such that the amount that flange 40 extends from support member 12 is adjustable.

A user may attach footwear 10 to his/her foot and perform a variety of maneuvers in a proprioceptive and/or kinesthetic exercise plan for the lower foot, upper leg and even upper torso and other body parts and organs. For example, footwear 10 may be used to reestablish neuromuscular control during rehabilitation of joints, to restore the mechanical and functional stability of the neuromuscular system, to improve or rehabilitate anticipatory (feed-forward) and reflexive (feedback) neuromuscular control mechanism, and to regain and improve balance, postural equilibrium and core stability.

Figure 5:
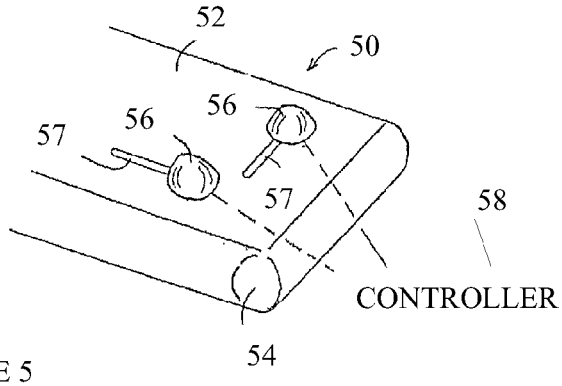
FIG. 5 is a simplified pictorial illustration of a treadmill constructed and operative in accordance with an embodiment of the present invention.

Reference is now made to FIG. 5, which illustrates a treadmill 50 constructed and operative in accordance with an embodiment of the present invention.

Treadmill 50 may comprise a foot-contact running surface 52 that rotates about a pair of spaced pulleys 54. Running surface 52 may comprise one or more protuberances 56 protruding upwards from running surface 52. Protuberances 56 may be of different or similar configuration (e.g., height, size, shape and/or slope). Protuberances 56 may have a fixed size/shape, or alternatively, may have a variable size/shape. The variable size/shape may be achieved by constructing protuberance 56 from an inflatable element, which may be inflated pneumatically with air or hydraulically with a liquid (e.g., water or oil). A controller 58 may be provided that controls inflation and deflation of protuberances 56. Protuberances 56 and/or running surface 52 may have different or similar material properties. For example, they may have different or similar resilience or viscosity (in the inflatable version) and may be made of different or similar materials.

Protuberances 56 may be movable. For example, one or more of the protuberances 56 may be translatable such as in a track 57 (e.g., forwards, backwards, sideways or diagonally) and/or rotatable about its own or other axis, or a combination of such motions. A protective strap (not shown) may be provided to maintain the user in an upright position and help prevent accidental falls.

Figure 6:
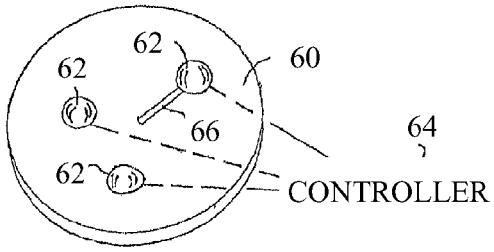
FIG. 6 is a simplified pictorial illustration of an exercise surface constructed and operative in accordance with an embodiment of the present invention.

Reference is now made to FIG. 6, which illustrates an exercise surface 60 constructed and operative in accordance with an embodiment of the present invention. Exercise surface 60 may comprise one or more protuberances 62 protruding upwards from the upper (foot-contacting) face and/or lower (floor-contacting) face of exercise surface 60. Protuberances 62 may be of different or similar configuration (e.g., height, size, shape and/or slope). Protuberances 62 may have a fixed size/shape, or alternatively, may have a variable size/shape. The variable size/shape may be achieved by constructing protuberance 62 from an inflatable element, which may be inflated pneumatically with air or hydraulically with a liquid (e.g., water or oil). A controller 64 may be provided that controls inflation and deflation of protuberances 62. Protuberances 62 may have different or similar resilience or viscosity (in the inflatable version), and may be made of different or similar materials.

Protuberances 62 may be movable. For example, one or more of the protuberances 62 may be translatable such as in a track 66 (e.g., forwards, backwards, sideways, radially or diagonally) and/or rotatable about its own or other axis, or a combination of such motions. A user of the exercise surface 60 may thus move in six degrees of freedom (translating in three mutually orthogonal directions (x, y, z) and rotating about these axes (azimuth, elevation and roll)).

Figure 7:
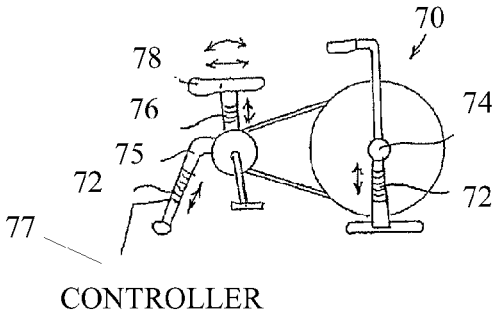
FIG. 7 is a simplified pictorial illustration of an exercise bicycle constructed and operative in accordance with an embodiment of the present invention.

Reference is now made to FIG. 7, which illustrates a stationary exercise bicycle 70 constructed and operative in accordance with an embodiment of the present invention. Exercise bicycle 70 may comprise apparatus with its own pedals, wheel and sensors (e.g., speedometer, odometer, etc.) or may comprise an indoor bicycle trainer, wherein a user mounts a bicycle to a stand, which permits pedaling the bicycle while the bicycle remains stationary. Exercise bicycle 70 may comprise a bumping mechanism 72 connected to a front axle 74 or rear support 75 of bicycle 70 and/or a bumping mechanism 76 connected to a seat 78 of bicycle 70. The bumping mechanisms may oscillate, rock, bump and otherwise disrupt the balance of the user of the exercise bicycle 70 (as indicated by arrows in FIG. 7). The bumping mechanisms may move the rider in six degrees of freedom (translation in three mutually orthogonal directions (x, y, z) and rotation about these axes (azimuth, elevation and roll)). The bumping mechanisms in this embodiment, as in other embodiments of the invention, may comprise a plate on which exercise bicycle 70 is mounted, wherein the plate provides the bumping action in six degrees of freedom.

Exercise bicycle 70 may be used to exercise the neuromuscular control in the back, hip, pelvis, ankle, knee and other parts of the body by means of bumps during riding, which may simulate riding on bumpy roads. A controller 77 may be provided to control operation of bumping mechanism 72.

Figure 8:
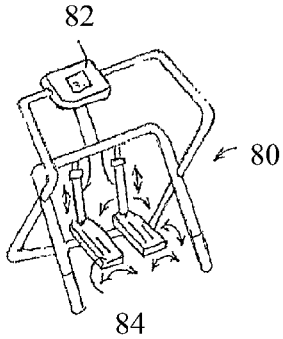
FIG. 8 is a simplified pictorial illustration of an exercise stepper constructed and operative in accordance with an embodiment of the present invention.

Reference is now made to FIG. 8, which illustrates an exercise stepper 80, constructed and operative in accordance with an embodiment of the present invention. Exercise stepper 80 may comprise a controller 82 that varies the resistive force offered by pedals 84 of the stepper 80. Controller 82 may also vary the angle of the pedals 84, such as to create eversion and inversion, as indicated by arrows in FIG. 8. Here too, controller 82 may move the pedals 84 in six degrees of freedom (translation in three mutually orthogonal directions (x, y, z) and rotation about these axes (azimuth, elevation and roll)).

Figure 9:
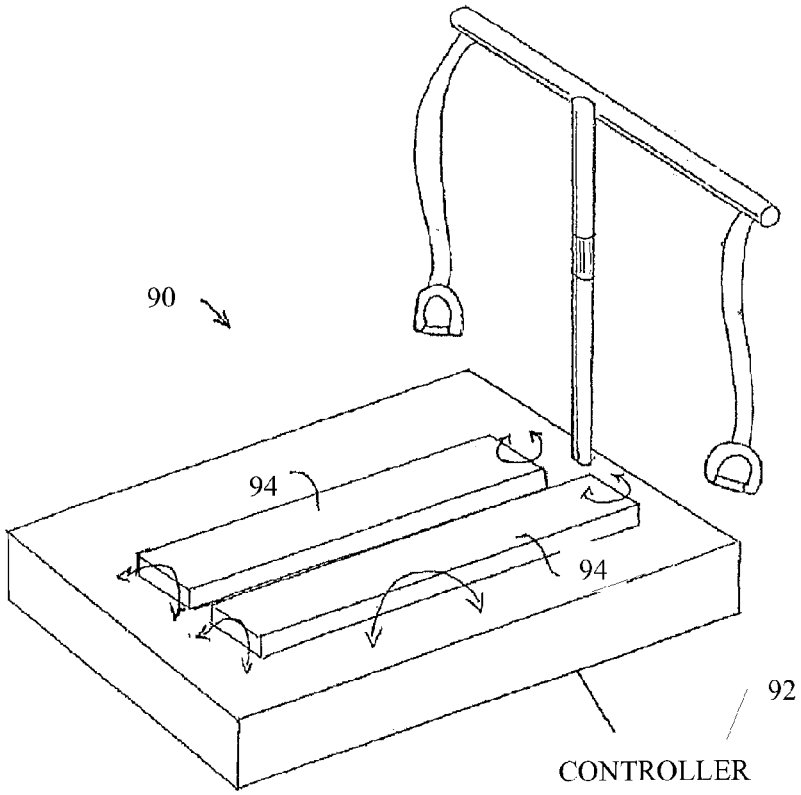
FIG. 9 is a simplified pictorial illustration of a ski machine constructed and operative in accordance with an embodiment of the present invention.

Reference is now made to FIG. 9, which illustrates a ski machine 90, constructed and operative in accordance with an embodiment of the present invention. Ski machine 90 may comprise a controller 92 that varies the resistive force offered by ski platforms 94 of the ski 90. Controller 92 may also vary the angle of ski platforms 94, such as to create eversion and inversion, as indicated by arrows in FIG. 9. Controller 92 may move the ski platforms 94 in six degrees of freedom (translation in three mutually orthogonal directions (x, y, z) and rotation about these axes (azimuth, elevation and roll)).

Some exercise experts have noted several drawbacks to prior art exercise equipment. For example, stationary exercise bicycles may utilize only a relatively small number of muscles, throughout a fairly limited range of motion. Cross-country skiing devices may exercise more muscles than a stationary bicycle, however, the substantially flat shuffling foot motion of the device may limit the range of motion of some of the muscles being exercised. Stair climbing devices may exercise more muscles than stationary bicycles, however, the limited range of up-and-down motion may not exercise the leg muscles through a large range of motion.

In response to these concerns, elliptic exercise machines have been developed that simulate natural walking and running motions and exercise a large number of muscles through a large range of motion. The machines provide variable, flexibly coordinated elliptical motion of the leg muscles. An example of one of the many elliptic exercise machines in the prior art is described in U.S. Pat. No. 5,848,954.

Figure 10:
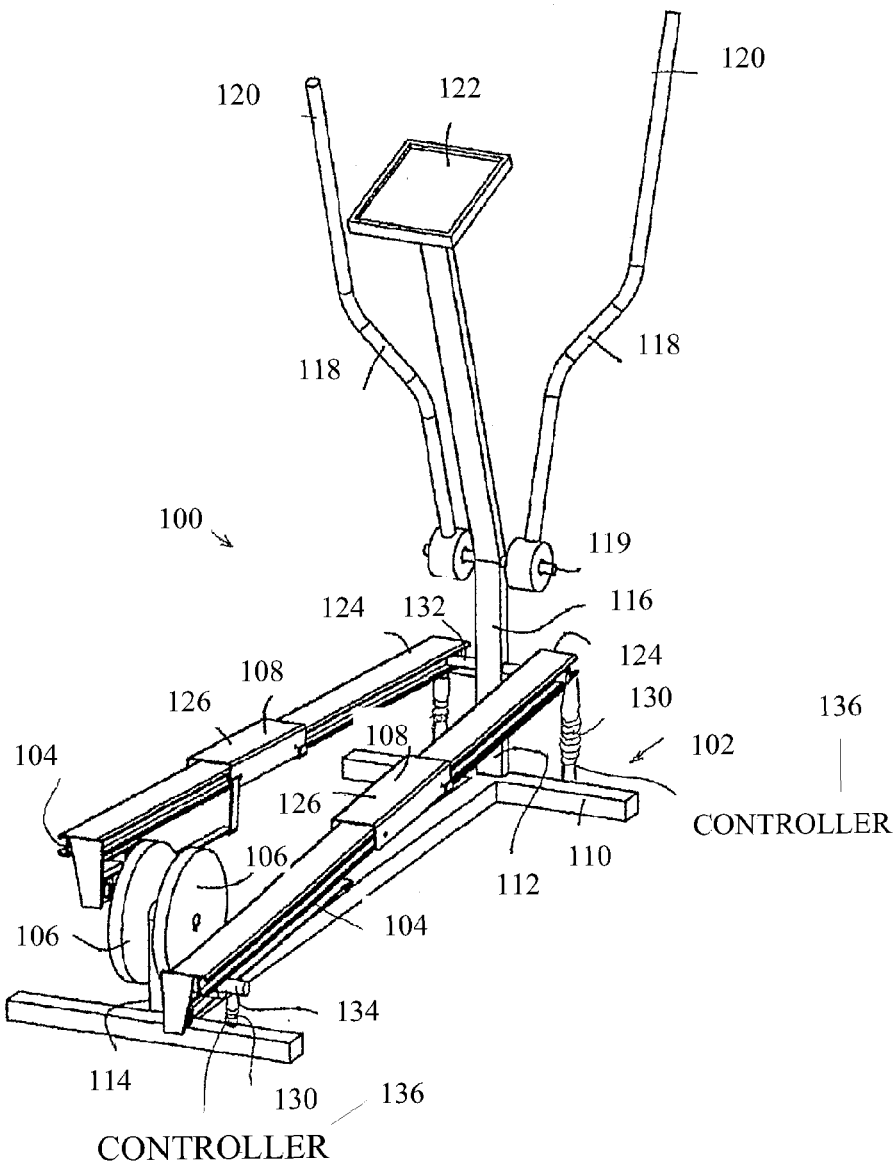
FIG. 10 is a simplified pictorial illustration of an elliptic exercise machine constructed and operative in accordance with an embodiment of the present invention.

Reference is now made to FIG. 10, which illustrates an elliptic exercise machine 100, constructed and operative in accordance with an embodiment of the present invention. Elliptic exercise machine 100 is shown for convenience with some elements similar to that of U.S. Pat. No. 5,848,954, but it is emphasized that the invention is not limited to this construction. In any case, the proprioceptive features of the invention are not found in U.S. Pat. No. 5,848,954 or any of the prior art.

Elliptic exercise machine 100 may comprise a frame 102 and a linkage assembly 104 movably mounted on frame 102. Linkage assembly 104 may generally move relative to frame 102 in a manner that links rotation of a flywheel 106 to generally elliptical motion of a force receiving member or "skate" 108. Frame 102 may include a base 110, a forward stanchion or upright 112, and a rearward stanchion or upright 114.

It is noted that the term "elliptical motion" is intended in a broad sense to describe a closed path of motion having a relatively longer first axis and a relatively shorter second axis (which extends perpendicular to the first axis). It is further noted that in the illustrated embodiment, there is left-right symmetry about a longitudinal axis, and the "right-hand" components are 180 degrees out of phase relative to the "left-hand" components. However, like reference numerals are used to designate both the "right-hand" and "left-hand" parts on elliptic exercise machine 100, and when reference is made to one or more parts on only one side of the machine, it is to be understood that corresponding part(s) are disposed on the opposite side of the machine.

The forward stanchion 112 may extend perpendicularly upward from base 110 and support a telescoping tube or post 116. A pair of handles 118 may be pivotally mounted to post 116 at a pivot 119. Handles 118 may have gripping portions 120. A display 122 may be disposed on post 116. Skates 108 may slide on rails 124. A user may place his/her foot on a foot-contacting surface 126 of skate 108.

In accordance with an embodiment of the present invention, elliptic exercise machine 100 may comprise one or more bumping mechanisms 130 connected to a front support 132 and/or a rear support 134 of rails 124. The bumping mechanisms 130 may oscillate, rock, bump and otherwise disrupt the balance of the user of elliptic exercise machine 100. The bumping mechanisms 130 may move the user in six degrees of freedom (translation in three mutually orthogonal directions (x, y, z) and rotation about these axes (azimuth, elevation and roll)). A controller 136 may be provided to control operation of bumping mechanism 130.

Figure 11:
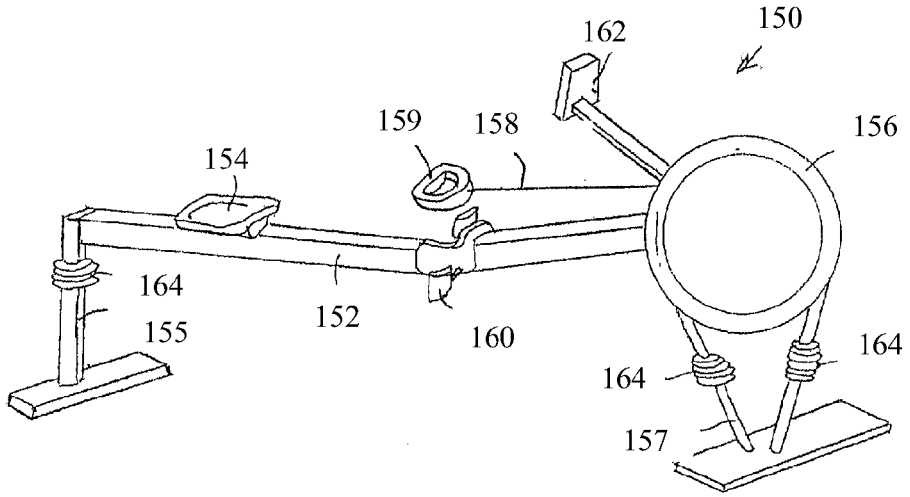
FIG. 11 is a simplified pictorial illustration of a rowing machine constructed and operative in accordance with an embodiment of the present invention.

Reference is now made to FIG. 11, which illustrates a rowing machine 150, constructed and operative in accordance with an embodiment of the present invention. Rowing machine 150 may comprise a rail 152 on which a seat 154 is slidingly mounted. Rail 152 may have a rear support 155. Rail 152 may extend from a forward-mounted tension drum 156, which may be mounted on a front support 157. A cord 158 may be wound around tension drum 156. Cord 158 may be provided with a handle 159. Footrests 160 may be mounted on rail 152.

A user (not shown) may sit on seat 154, place feet against the footrests 160, grasp handle 159 and pull cord 158 towards the rear of rowing machine 150, outwards from tension drum 156. This motion simulates the action of pulling oars in a rowboat. The seat 154 may slide back and forth on rail 152 during the rowing motion. Tension drum 156 resists the pulling action on cord 158, thereby exercising muscles used in rowing. The tension in tension drum 156 may be adjusted to suit the desired level of exercise. A controller 162 may be provided that varies the resistive force offered by tension drum 156.

In accordance with an embodiment of the present invention, rowing machine 150 may comprise one or more bumping mechanisms 164 connected to front support 157 and/or rear support 155 of rail 152, or to seat 154. The bumping mechanisms 164 may oscillate, rock, bump and otherwise disrupt the balance of the user of rowing machine 150. The bumping mechanisms 164 may move the user in six degrees of freedom (translation in three mutually orthogonal directions (x, y, z) and rotation about these axes (azimuth, elevation and roll)). Controller 162 may control operation of bumping mechanisms 164.

In some embodiments of the present invention, at least two bulbous protuberances 22 protrude from a lower surface 24 of support member 12. In some embodiments of the present invention, only two bulbous protuberances 22 protrude from a lower surface 24 of support member 12. In some embodiments of the present invention, a lower surface of support member is an outsole. In some embodiments of the present invention, only two bulbous protuberances 22 protrude from a lower surface 24 of support member 12. In some embodiments of the present invention, the ground engaging parts of the device are only the bulbous protuberances 22. In some embodiments of the present invention, during all phases of gait including the stance phase the bulbous protuberances 22 are the only parts of the device which are ground engaging. In some embodiments of the present invention, during all phases of gait including the stance phase the bulbous protuberances 22 are the only parts of the device which are in direct contact with the ground.

In some embodiments of the present invention, a protuberance as described herein is movable. In some embodiments of the present invention, a protuberance as described herein is mountable. In some embodiments of the present invention, a protuberance as described herein is replaceable. In some embodiments of the present invention, a protuberance as described herein is movable along the outer surface of the support member. In some embodiments of the present invention, a protuberance as described herein is movable along the outer surface of the outsole. In some embodiments of the present invention, a protuberance as described herein can be positioned within the outer surface of the support member.

In some embodiments of the present invention a protuberance is fixed in a predetermined location. In some embodiments of the present invention, a protuberance is movable within a predefined area. In some embodiments of the present invention, a protuberance is movable within an area of 1 $cm^2$ to 18 $cm^2$. In some embodiments of the present invention, a protuberance is movable within an area of 1 $cm^2$ to 6 $cm^2$. In some embodiments of the present invention, a protuberance is movable within an area of 1 $cm^2$ to 4 $cm^2$. In some embodiments of the present invention, a protuberance is movable within an area of 2 $cm^2$ to 8 $cm^2$. In some embodiments of the present invention, a protuberance is movable within an area of 3 $cm^2$ to 6 $cm^2$. In some embodiments of the present invention, a protuberance is movable within an area of 4 $cm^2$ to 10 $cm^2$. In some embodiments of the present invention, a protuberance is movable within an area of 5 $cm^2$ to 18 $cm^2$. In some embodiments of the present invention, a protuberance is movable within an area of 4 $cm^2$ to 12 $cm^2$.

In some embodiments of the present invention, the predefined area within which the protuberance is movable is a circle. In other embodiments, a predefined area within which the protuberance is movable is a square. In other embodiments, a predefined area within which the protuberance is movable is an ellipse. In other embodiments, a predefined area within which the protuberance is movable is a rectangle. In other embodiments, a predefined area within which the protuberance is movable is quadrangular.

In some embodiments, the protuberance is hooked to a rail. In some embodiments, the protuberance is connected to a rail. In some embodiments, the protuberance is connected to a rail and is movable along the rail. In some embodiments, the protuberance is connected to a rail, is movable along the rail, and can be positioned and/or fixed anywhere along the rail.

As seen clearly in FIG. 2, one protuberance 22 may be positioned more posteriorly than the other protuberance 22. In some embodiments, a device as described herein comprises at least one anterior bulbous protuberance. In other embodiments, a device as described herein comprises at least one posterior bulbous protuberance. In other embodiments, the device includes one anterior bulbous protuberance and one posterior bulbous protuberance. In other embodiments, the device comprises at least one anterior bulbous protuberance and one moveable posterior bulbous protuberance. In other embodiments, the device comprises at least one moveable anterior bulbous protuberance and one posterior bulbous protuberance. In other embodiments, the device comprises at least one moveable anterior bulbous protuberance and one moveable posterior bulbous protuberance. In other embodiments, the device includes one moveable anterior bulbous protuberance and one moveable posterior bulbous protuberance.

The longitudinal centerline is defined, in some embodiments, as a longitudinal straight line connecting middles of the short sides of a rectangle which delimits a contour of the support member. The contour of the support member is defined, in some embodiments, as a foothold confined by an upper part of the footwear. The contour of the support member is defined, in some embodiments, as an outermost contour of the footwear. The contour of the support member is defined, in some embodiments, as a contour of a bottom surface of a sole of the footwear.

In some embodiments, the protuberances rise vertically, each protuberance including a base end and a peak end. In some embodiments, the surface area of the base is larger than the surface area of the peak. In some embodiments, the peak is the ground engaging portion of a protuberance.

In some embodiments, bulbous protuberance 22 protrudes from the upper surface 14 of support member 12. In some embodiments, each protuberance 22 has a curved outer contour 26. In some embodiments, each protuberance 22 has a different curved outer contour. In some embodiments, each protuberance 22 has a convexity. In some embodiments, each protuberance 22 has a different convexity. The cross-section of the contour 26, that is, either the cross-section taken with respect to a longitudinal axis 28 (FIG. 4) of support member 12 (corresponding to the shape seen in FIG. 2) or the cross-section taken with respect to a latitudinal axis 30 (FIG. 4) of support member 12 (corresponding to the shape seen in FIG. 3), or any other cross-section, may have any curvilinear shape. In some embodiments, the contours 26 may have the shape of a conic section, that is, the shape of a circle, ellipse, parabola or hyperbola. The various cross-sections of the contours 26 of protuberance 22 may be shaped identically or differently.

In some embodiments, as seen in FIG. 4, the protuberances are positioned on a common longitudinal axis of support member 12, such as the centerline 28 of support member 12. In some embodiments, the protuberances are positioned on opposite sides of the latitudinal midline 30. In some embodiments, the protuberances are positioned offset from the centerline 28 of support member 12, and on opposite sides of the latitudinal midline 30. In some embodiments, the meaning of "protuberance is positioned offset from the centerline" comprises that the peak or the ground engaging surface of a protuberances is positioned offset from the centerline. In some embodiments, the meaning of "protuberance is positioned offset from the centerline" comprises that only the peak or the ground engaging surface of a protuberances is positioned offset from the centerline but the centerline still crosses the protuberance. In some embodiments, the bases of the protuberances are positioned on the centerline of the support member. In some embodiments, the peaks of the protuberances are positioned on opposite sides of the centerline of support member. In some embodiments, the centerline divides longitudinally the calcaneus support portion into two equal halves and further extends towards the phalanges and metatarsals support portion in a straight line. In some embodiments, the centerline divides longitudinally the arch of the calcaneus support portion into two equal halves and further extends towards the phalanges and metatarsals support portion in a straight line. In some embodiments, the centerline divides longitudinally the proximal arch of the calcaneus support portion into two equal halves and further extends towards the phalanges and metatarsals support portion in a straight line. In some embodiments, the centerline divides longitudinally the support portion as seen in FIG. 4 of the calcaneus support portion into two equal halves and further extends towards the phalanges and metatarsals support portion in a straight line.

In some embodiments, the bases of the protuberances are positioned on the centerline of the support member and the peaks of the protuberances are positioned on opposite sides of the centerline of support member. In some embodiments, the bases of the protuberances are positioned on the centerline of the support member but the peaks of the protuberances are offset from the centerline of the support member. In some embodiments, the bases of the protuberances are positioned on the centerline of the support member but the peaks of the protuberances are positioned on opposite sides of the centerline of the support member.

In some embodiments, the anterior protuberance is positioned medially from the centerline of the support member. In some embodiments, the peak of the anterior protuberance is positioned medially from the centerline of the support member. In some embodiments, the base of the anterior protuberance is position on the centerline of the support member but the peak of the anterior protuberance is positioned medially from the centerline of the support member. In some embodiments, the anterior protuberance is positioned laterally from the centerline of the support member. In some embodiments, the peak of the anterior protuberance is positioned laterally from the centerline of the support member. In some embodiments, the base of the anterior protuberance is position on the centerline of the support member but the peak of the anterior protuberance is positioned laterally from the centerline of the support member. In some embodiments, the posterior protuberance is positioned medially from the centerline of the support member. In some embodiments, the peak of the posterior protuberance is positioned medially from the centerline of the support member. In some embodiments, the base of the posterior protuberance is positioned on the centerline of the support member but the peak of the posterior protuberance is positioned medially from the centerline of the support member. In some embodiments, the posterior protuberance is positioned laterally from the centerline of the support member. In some embodiments, the peak of the posterior protuberance is positioned laterally from the centerline of the support member. In some embodiments, the base of the posterior protuberance is position on the centerline of the support member but the peak of the posterior protuberance is positioned laterally from the centerline of the support member.

In some embodiments, the term sneaker comprises a boot. In some embodiments, the term sneaker comprises a walking boot. In some embodiments, sneaker comprises a platform of a running shoe.

In some embodiments, the ground engaging parts of the device are only the protuberances. In some embodiments, during all phases of gait including the stance phase the protuberances are the only parts of the device which are ground engaging. In some embodiments, during the stance phase the protuberances are the only parts of the device which are ground engaging. Each possibility represents a separate embodiment of the present invention.

In some embodiments, a protuberance is movable within a predefined area. In some embodiments, a protuberance is movable within an area of 1 $cm^2$ to 18 $cm^2$. In some embodiments, a protuberance is movable within an area of 1 $cm^2$ to 6 $cm^2$. In some embodiments, a protuberance is movable within an area of 1 $cm^2$ to 4 $cm^2$. In some embodiments, a protuberance is movable within an area of 2 $cm^2$ to 8 $cm^2$. In some embodiments, a protuberance is movable within an area of 3 $cm^2$ to 6 $cm^2$. In some embodiments, a protuberance is movable within an area of 4 $cm^2$ to 10 $cm^2$. In some embodiments, a protuberance is movable within an area of 5 $cm^2$ to 18 $cm^2$. In some embodiments, a protuberance is movable within an area of 4 $cm^2$ to 12 $cm^2$. Each possibility represents a separate embodiment of the present invention.

In some embodiments, the footwear 10 comprises a support member 12 having a periphery in a shape of a shoe sole with an upper surface 14. In some embodiments, the footwear 10 comprises an insole placed on top of the upper surface 14. In some embodiments, the insole is the interior bottom of footwear 10. In some embodiments, the insole sits directly beneath the foot. In some embodiments, the insole is removable, replaceable, or both. In some embodiments, the insole adds comfort, control the shape, moisture, smell, or any combination thereof. In some embodiments, the insole is placed to correct defects in the natural shape of the foot or positioning of the foot during standing or walking. Each possibility represents a separate embodiment of the present invention.

In some embodiments, the peak or the ground engaging surface of the anterior protuberance is positioned laterally from the centerline of the support member. In some embodiments, the peak or the ground engaging surface of the anterior protuberance is positioned medially from the centerline of the support member. In some embodiments, the peak or the ground engaging surface of the anterior protuberance is positioned laterally from the centerline of the support member and the peak or the ground engaging surface of the posterior protuberance is aligned with centerline. In some embodiments, the peak or the ground engaging surface of the anterior protuberance is positioned medially from the centerline of the support member and the peak or the ground engaging surface of the posterior protuberance is aligned with centerline. Each possibility represents a separate embodiment of the present invention.

In some embodiments, the peak or the ground engaging surface of the posterior protuberance is positioned laterally from the centerline of the support member. In some embodiments, the peak or the ground engaging surface of the posterior protuberance is positioned medially from the centerline of the support member. In some embodiments, the peak or the ground engaging surface of the posterior protuberance is positioned laterally from the centerline of the support member and the peak or the ground engaging surface of the anterior protuberance is aligned with centerline. In some embodiments, the peak or the ground engaging surface of the posterior protuberance is positioned medially from the centerline of the support member and the peak or the ground engaging surface of the anterior protuberance is aligned with centerline. Each possibility represents a separate embodiment of the present invention.

In some embodiments, the peak or the ground engaging surface of the posterior protuberance is positioned laterally from the centerline of the support member and the peak or the ground engaging surface of the anterior protuberance is positioned medially from the centerline of the support member. In some embodiments, the peak or the ground engaging surface of the anterior protuberance is positioned laterally from the centerline of the support member and the peak or the ground engaging surface of the posterior protuberance is positioned medially from the centerline of the support member. Each possibility represents a separate embodiment of the present invention.

In some embodiments, protuberances are of different heights. In some embodiments, protuberances are of different weights. In some embodiments, a footwear of the invention further comprises a spacer located between the base of a protuberance and the support member or outsole. In some embodiments, a spacer is used for adjusting the height of a protuberance, the weight of a protuberance or a combination thereof.

In some embodiments, a spacer or a protuberance comprises a diameter of 50-150 mm. In some embodiments, a spacer or a protuberance comprises a diameter of 55-110 mm. In some embodiments, a spacer or a protuberance comprises a diameter of 60-100 mm. In some embodiments, a spacer or a protuberance comprises a diameter of 80-90 mm. In some embodiments, a spacer or a protuberance comprises a diameter of 85 mm. In some embodiments, a spacer or a protuberance or a protuberance comprises a thickness of 1-12 mm. In some embodiments, a spacer or a protuberance comprises a thickness of 1-4 mm. In some embodiments, a spacer or a protuberance comprises a thickness of 3-10 mm. In some embodiments, a spacer or a protuberance comprises a thickness of 1-3 mm. In some embodiments, a spacer or a protuberance comprises hardness of 60-70 Shore A, which is a soft spacer. In some embodiments, a spacer or a protuberance comprises hardness of 90-100 Shore A, which is a hard spacer. In some embodiments, a spacer or a protuberance comprises hardness of 71-890 Shore A, which is medium hardness spacer.

In some embodiments, a spacer or a protuberance weighs 2-500 g. In some embodiments, a spacer or a protuberance weighs 2-250 g. In some embodiments, a spacer or a protuberance weighs 2-6 g. In some embodiments, a spacer or a protuberance weighs 2-20 g. In some embodiments, a spacer or a protuberance weighs 2-20 g is made of Nylon. In some embodiments, a spacer or a protuberance weighs 2-20 g is made of Nylon and fiber. In some embodiments, a spacer or a protuberance weighs 2-40 g is made of Nylon and glass fiber. In some embodiments, a spacer or a protuberance weighs 30-100 g. In some embodiments, a spacer or a protuberance weighs 50-80 g. In some embodiments, a spacer or a protuberance weighs 60-100 g. In some embodiments, a spacer or a protuberance comprises: Nylon glass fiber polyurethane an alloy (such as but not limited to Zink alloy), or any combination thereof. Each possibility represents a separate embodiment of the present invention.

In some embodiments, a protuberance is compressible. In some embodiments, a protuberance is deformable. In some embodiments, a protuberance is compressible or deformable upon pressure exerted by subject's weight. Each possibility represents a separate embodiment of the present invention.

In some embodiments, a protuberance has a shore hardness of between 30 to 90 Sh A. In some embodiments, a protuberance has a shore hardness of between 40 to 55 Sh A. In some embodiments, a protuberance has a shore hardness of between 50 to 70 Sh A. In some embodiments, a protuberance has a shore hardness of between 65 to 90 Sh A. In some embodiments, a protuberance has a shore hardness of between 55 to 60 Sh A. In some embodiments, a protuberance has a shore hardness of between 65 to 70 Sh A. In some embodiments, an anterior and a posterior protuberance comprise identical shore hardness. In some embodiments, an anterior and a posterior protuberance comprise different shore hardness. Each possibility represents a separate embodiment of the present invention.

In some embodiments, a protuberance is a soft protuberance comprising a shore hardness of between 40 to 55 Sh A. In some embodiments, a protuberance is a medium hardness protuberance comprising a shore hardness of between 50 to 70 Sh A. In some embodiments, a protuberance is a hard protuberance comprising a shore hardness of between 65 to 90 Sh A.

In some embodiments, a protuberance has an abrasion between 1-60 $mm^3$ (by DIN 53516). In some embodiments, a protuberance comprises a rubber cup. In some embodiments, a protuberance comprises natural rubber compounds. In some embodiments, a protuberance comprises synthetic rubber compounds such as TPU or TPR. In some embodiments, a protuberance comprises silicone. In some embodiments, a protuberance a plastic material such as PA 6 (nylon), PA6/6 (nylon)+glass fiber, ABS, Polypropylene, POM (Polyoxymethylene). In some embodiments, a protuberance comprises a metal such as aluminum, steel, stainless steel, brass, or metal alloys. In some embodiments, a protuberance comprises compound materials such as glass fibers, carbon fibers, kevlar, or any combination thereof. Each possibility represents a separate embodiment of the present invention.

As seen in FIG. 2, the posterior protuberance is positioned generally underneath a calcaneus (heel, ankle) support portion 23 of support member 12. In some embodiments, the anterior protuberance may be positioned generally underneath a metatarsals support portion 25 and/or phalanges support portion 27 of support member 12.

Figure 12:
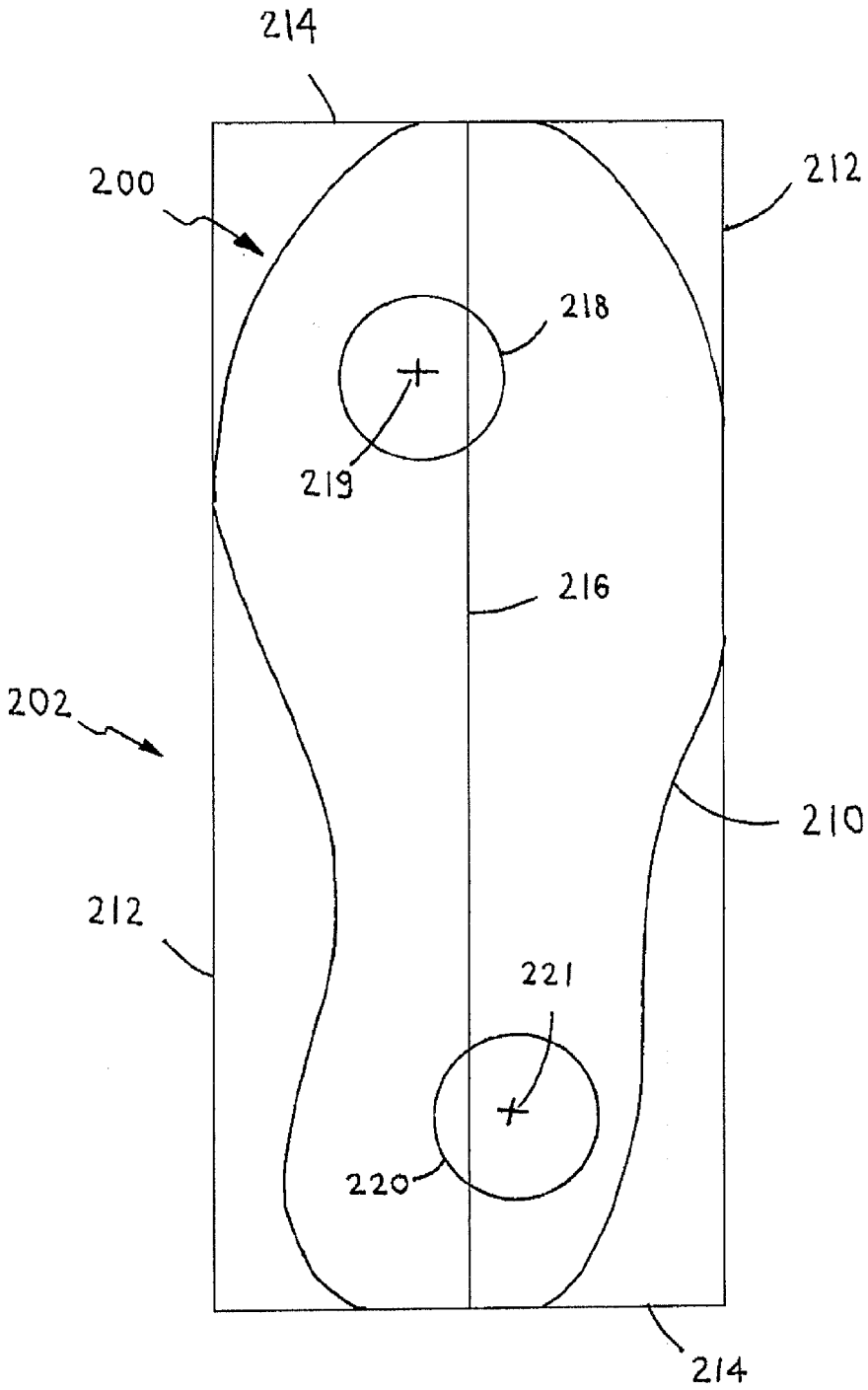
FIG. 12 is a simplified pictorial illustration of an alignment of the anterior (forward) and posterior (rearward) protuberances on a support member, according to embodiments of the present invention.

FIG. 12 is a simplified pictorial illustration of an alignment of the anterior (forward) and posterior (rearward) protuberances on a support member 200, according to embodiments of the present invention.

Centerline 216, in the embodiment shown in FIG. 12 is defined as a longitudinal straight line (median) that connects the middles of short sides 214 of a rectangle 212, the long sides 212 of which are parallel to centerline 216, and which delimits the contour 210 of the support member. In embodiments of the present invention contour 210 is the contour (254, see FIG. 14) of the foothold confined by the upper part (252, see FIG. 14) of the footwear (250, see FIG. 14), corresponding to the last which is used to form the footwear. In other embodiments of the present invention contour 210 is the outermost contour of the footwear. In other embodiments of the present invention contour 210 is the contour of the bottom surface of the sole of the footwear.

According to embodiments of the present invention, as shown in FIG. 12, forward protuberance 218 at the anterior (phalanges) portion of the support member (i.e. its front portion) is positioned medially offset to centerline 216. By "medially offset" is meant that a peak surface of protuberance 218 (marked by cross 219) is shifted from centerline 216 medially towards the inner side of support surface 200, facing the support member of the other foot (not shown in this figure). The peak surface is a surface on the protuberance which is furthest from the support surface with respect to other surfaces of the protuberance, and which comes in contact with the ground, when the user attaches the support member to the foot, and walks or stands on the ground.

According to embodiments of the present invention, as shown in FIG. 12, rearward protuberance 220 at the posterior (calcaneus) portion of the support member (i.e. its back portion) is positioned laterally offset to centerline 216. By "laterally offset" is meant that a peak surface of protuberance 220 (marked by cross 221) is shifted from centerline 216 laterally towards the outer side of support surface 200, away from the support member of the other foot (not shown in this figure).

In some embodiments of the present invention only forward protuberance 218 is offset medially, while rearward protuberance 220 is substantially aligned with centerline 216. In some embodiments of the present invention only rearward protuberance 220 is offset medially, while forward protuberance 218 is substantially aligned with centerline 216.

The alignment of the protuberances shown in FIG. 12 is useful, for example, for exercising users with one or more of the following medical indications: medial compartment—knee osteoarthritis (OA), medical meniscus tear or damage, genu varus, patello-femoral pain syd, patello-femoral problem (malalignment), lateral collateral ligamental damage or tear, bone bruise or avascular necrosis of the medial tibial plateau or the medial femoral condyle MTP/MFC (AVN), low back pain, hip OA, hip labrum damage (TCM), trochanteric bursitis, pes anseninus bursitis, ankle instability (supination and ext rut), achilles tendonitis and metatarsalgia.

Figure 13:
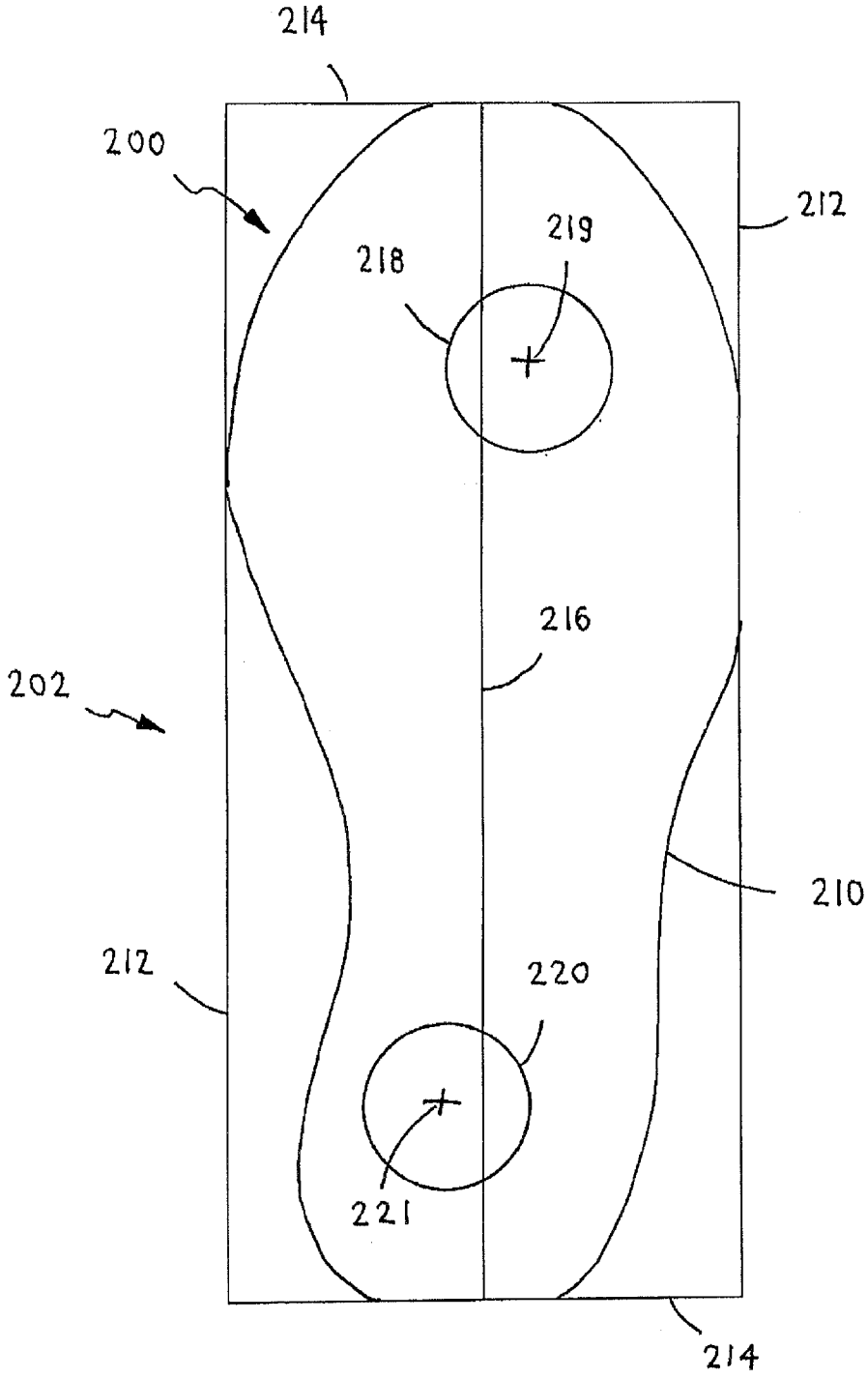
FIG. 13 is a simplified pictorial illustration of another alignment of the anterior and posterior protuberances on a support member, according to embodiments of the present invention.

FIG. 13 is a simplified pictorial illustration of another alignment of the anterior and posterior protuberances on a support member, according to embodiments of the present invention.

According to embodiments of the present invention, as shown in FIG. 13, forward protuberance 218 is laterally offset to centerline 216, whereas rearward protuberance 220 is medially offset to centerline 216.

In some embodiments of the present invention only forward protuberance 218 is offset laterally, while the rearward protuberance 220 is substantially aligned with centerline 216. In some embodiments of the present invention only rearward (posterior) protuberance 220 is offset laterally, while the forward (anterior) protuberance 216 is substantially aligned with centerline 216.

The alignment of the protuberances shown in FIG. 12 is useful, for example, for exercising users with one or more of the following medical indications: lateral meniscus tear or damage, lateral compartment knee osteoarthritis, valgus knee (genu valgus), patello-femoral pain syndrome, patello-femoral problem (malalignment),Medial collateral Ligament tear, bone bruise or avascular necrosis of the lateral tibial plateau or lateral femoral condyle hip labrum damage or tear, hip pain, ankle instability (pronoation), achilles tendonitis, tibilias insufficiency and metatarsalgia.

Figure 14:
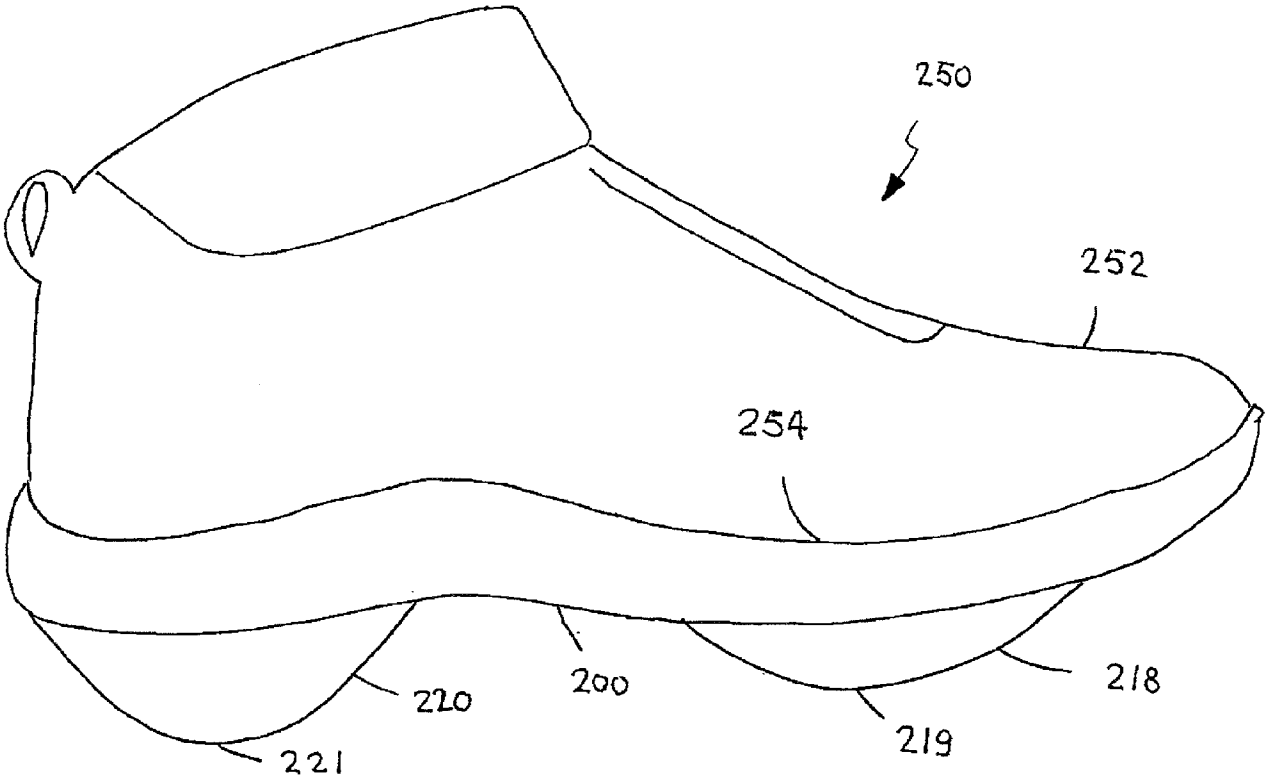
FIG. 14 is a simplified pictorial illustration of a sneaker constructed and operative in accordance with an embodiment of the present invention, whose rearward protuberance has a greater height than the height of the forward protuberance.

FIG. 14 is a simplified pictorial illustration of a sneaker 250 constructed and operative in accordance with an embodiment of the present invention, whose rearward protuberance 220 has a greater height than the height of the forward protuberance 218. It is noticeable that such arrangement facilitates initial contact between rearward protuberance 220 and the supporting ground (not shown in this figure) when a user wears the sneaker, before the forward protuberance is brought in contact with the ground. When both protuberances are placed in contact with the ground the foot of the user wearing sneaker 250 acquires a downward inclination with respect to direction of gait of the user.

Figure 15:
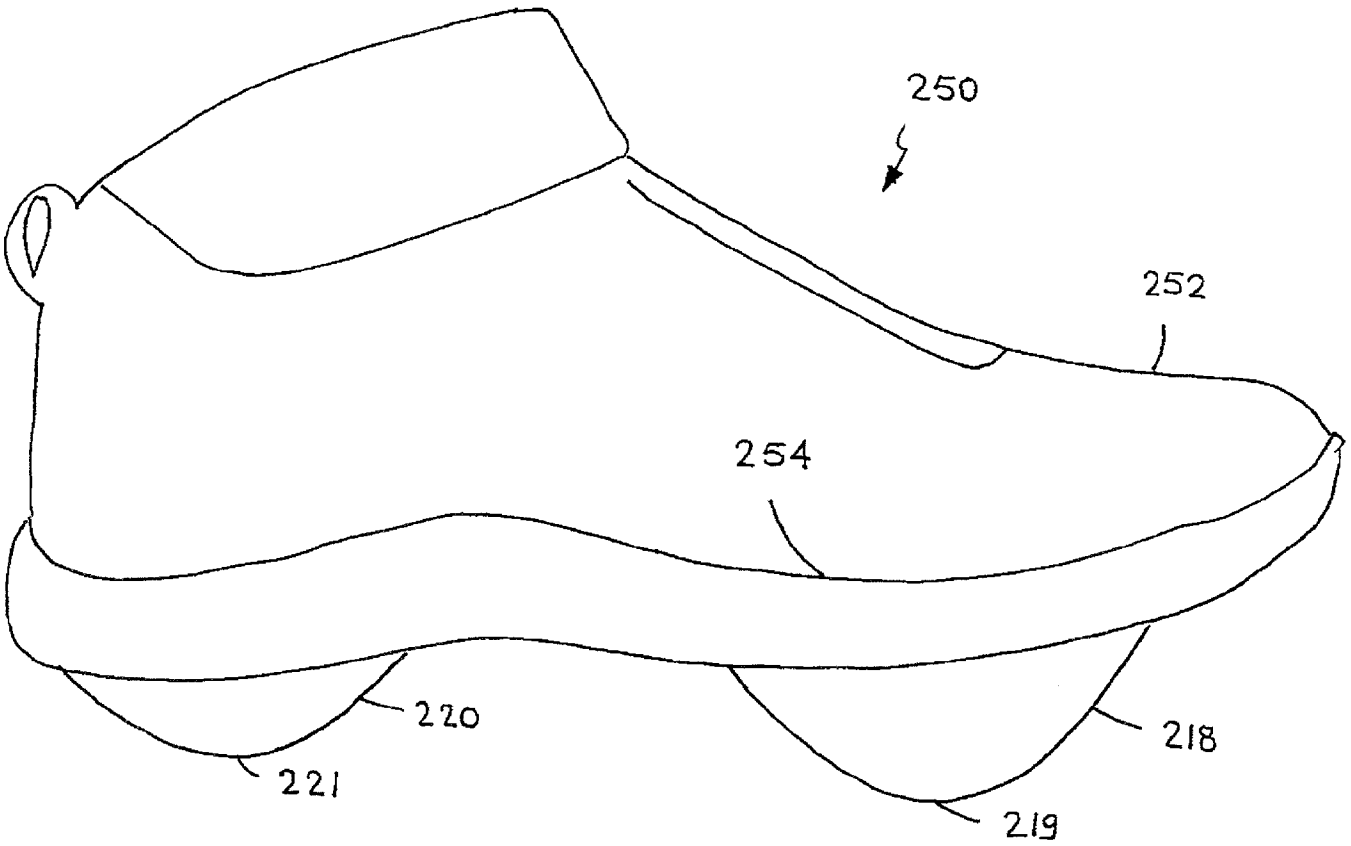
FIG. 15 is a simplified pictorial illustration of a sneaker constructed and operative in accordance with an embodiment of the present invention, whose forward protuberance has a greater height than the height of the rearward protuberance.

FIG. 15 is a simplified pictorial illustration of a sneaker 250 constructed and operative in accordance with an embodiment of the present invention, whose forward protuberance 218 has a greater height than the height of the rearward protuberance 220. In this embodiment when both protuberances are placed in contact with the ground the foot of the user wearing sneaker 250 acquires an upward inclination (with respect to the direction of gait of the user.

Figure 16:
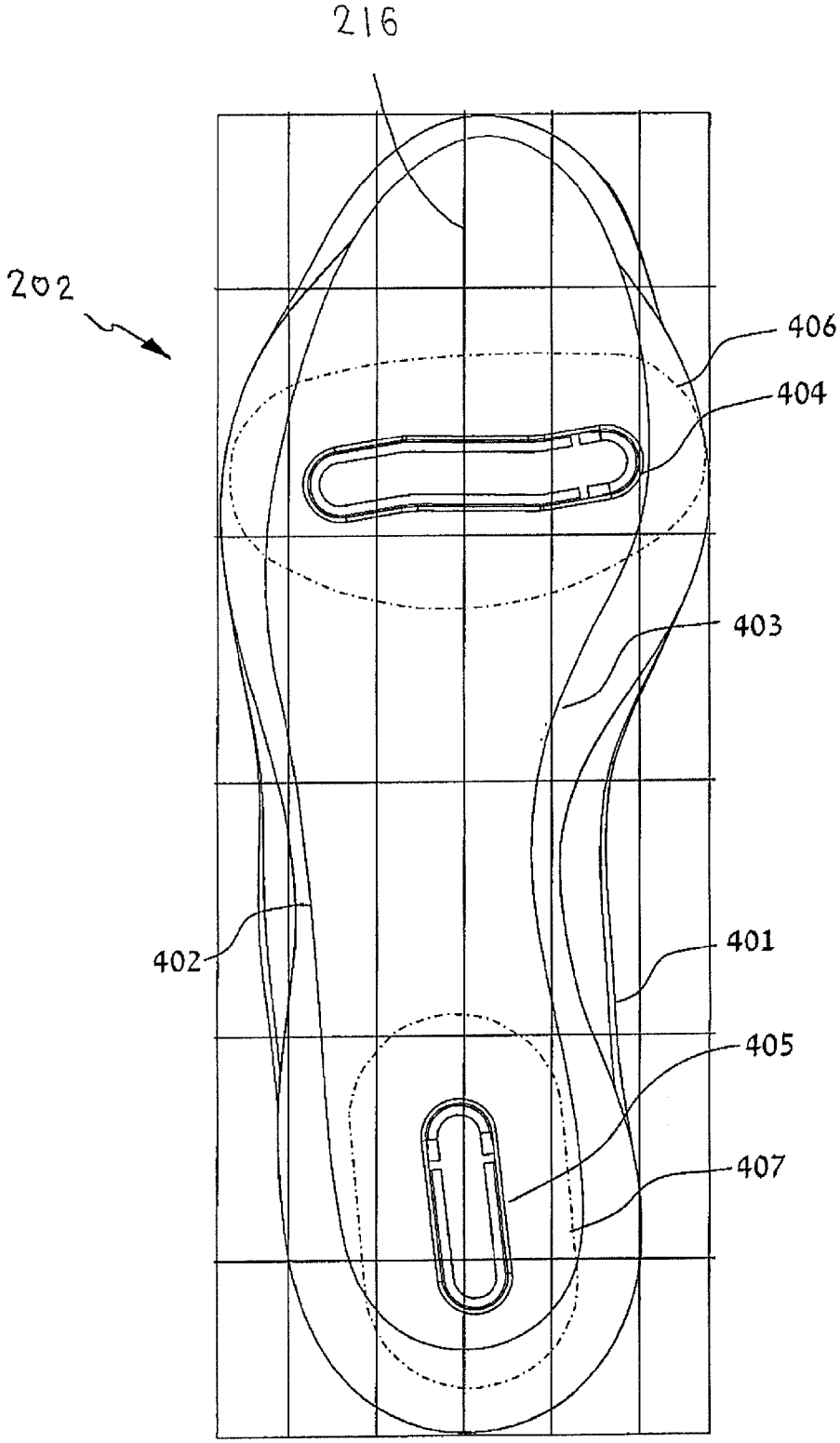
FIG. 16 illustrates maximal area boundaries of positioning of the anterior and posterior protuberances with respect to a support surface, according to embodiments of the present invention.

FIG. 16 illustrates maximal area boundaries of positioning of the anterior and posterior protuberances with respect to a support surface, according to embodiments of the present invention. Shown in this figure is a bottom view of a sneaker designed to be worn on a right foot of a user. The medial side is thus the right side of the drawing, facing the arc of greater curvature of the side arcs of the sneaker. The lateral side is opposite to the medial side, that is the left side of the drawing, facing the arc of lesser curvature of the side arcs of the sneaker. A grid is provided, dividing rectangle 202 to 6×6 sub-rectangles (other divisions may apply too), to aid in the determining the position of the protuberances.

Indicated are the midsole 401 and contour 402 of the foothold which is determined by the last used in the making of the sneaker, 403 marking the medial curvature of contour 402. Front rail 404 and rear rail 405 are used for anchoring the protuberance. The area bordered by dotted line 406 marks the maximal area within which the peak surface of the anterior protuberance, i.e. the ground engaging surface of the anterior protuberance, may be located, according to some embodiments of the present invention. On the 6×6 grid, area 406 mainly stretches across the second row of sub-rectangles (counting from the front), and some of the third row of sub-rectangles. The area bordered by dotted line 407 marks the maximal area within which the peak surface of the posterior protuberance. On the 6×6 grid, area 407 mainly stretches across the third and forth sub-rectangles (adjacent centerline 216) of the fifth row (counting form the front) of the grid.

Figure 17:
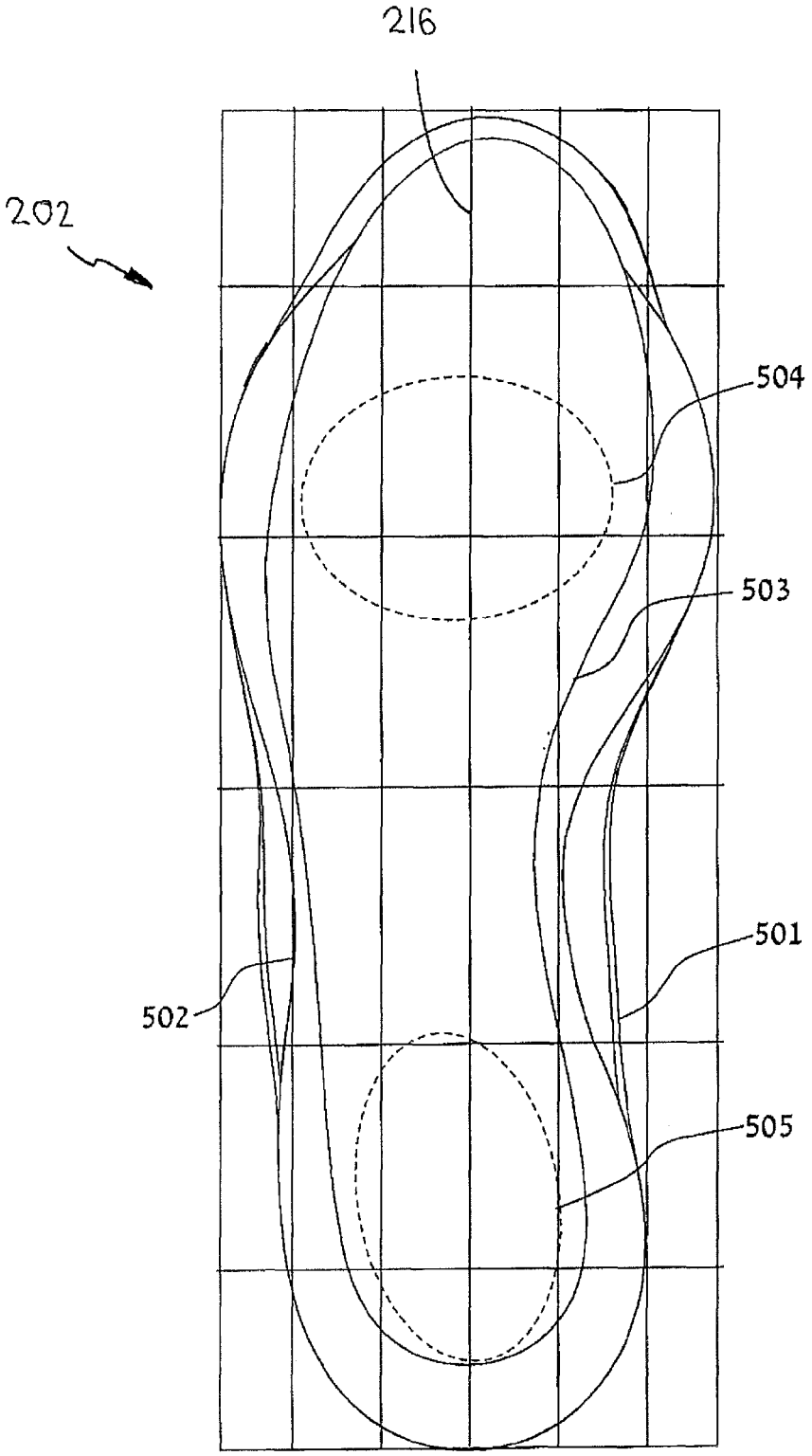
FIG. 17 illustrates effective area boundaries of positioning of the anterior and posterior protuberances with respect to a support surface, according to embodiments of the present invention.

FIG. 17 illustrates the effective area boundaries of positioning of the anterior and posterior protuberances with respect to a support surface, according to embodiments of the present invention. Indicated are the midsole 501 and outsole 502, contour 503 of the foothold which is determined by the last used in the making of the sneaker.

The area bordered by dotted line 504 marks the effective area within which the peak surface of the anterior protuberance, i.e. the ground engaging surface of the anterior protuberance, may be located, according to some embodiments of the present invention. On the 6×6 grid, area 504 mainly stretches across four sub-rectangles—two on either sides of centerline 216, of the second row of sub-rectangles (counting from the front), and some of the third row of sub-rectangles.

The area bordered by dotted line 505 marks the effective area within which the peak surface of the posterior protuberance. "Effective" refers to the effectiveness of use of the footwear according to embodiments of the present invention, which facilitates noticeable and useful proprioceptive/kinesthetic workout. On the 6×6 grid, area 505 mainly stretches across the third and forth sub-rectangles (adjacent centerline 216) of the fifth row (counting form the front) of the grid.

It is noted that the term "bulbous protuberance" is taken in the broadest sense to also include a cut bulbous protuberance, a truncated bulbous protuberance, a trimmed bulbous protuberance. If trimmed or cut, the trimmed or cut portion serves as the ground engaging of the protuberance, the base surface or both (e.g. both sides are cut or trimmed).

Figure 18A:
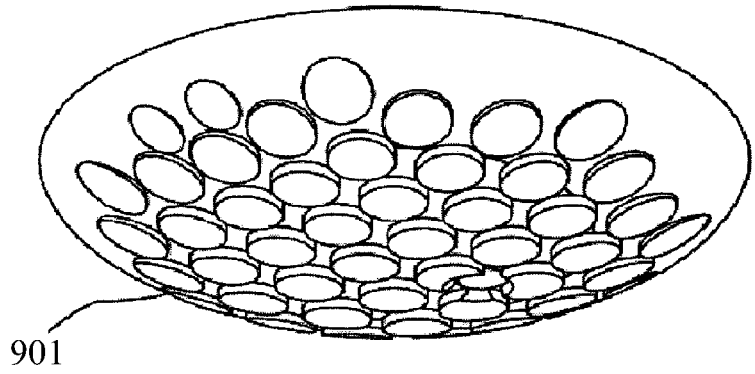
FIG. 18A is an isometric view of a protuberance suitable for use on a footwear, according to embodiments of the present invention.

FIG. 18A is an isometric view of a protuberance suitable for use on a footwear, according to embodiments of the present invention. Cleats 901 are provided on the surface of the protuberance for facilitating enhanced grip of the surface on which the user stands or walks. In some embodiments, spikes or grip means are constructed of any suitable material, such as but not limited to: elastomers such as rubbers or plastic materials. In some embodiments, spikes or grip means cover only a portion of a protuberance. In some embodiments, spikes or grip means cover at least a ground engaging surface of a protuberance (the surface in contact with the ground during stance). In some embodiments, a fixing means for securing a protuberance to the support portion is embedded within a spikes or a grip means. In some embodiments, a fixing means for securing a protuberance to the support portion is places in between spikes or a grip means. Each possibility represents a separate embodiment of the present invention.

Figure 18B:
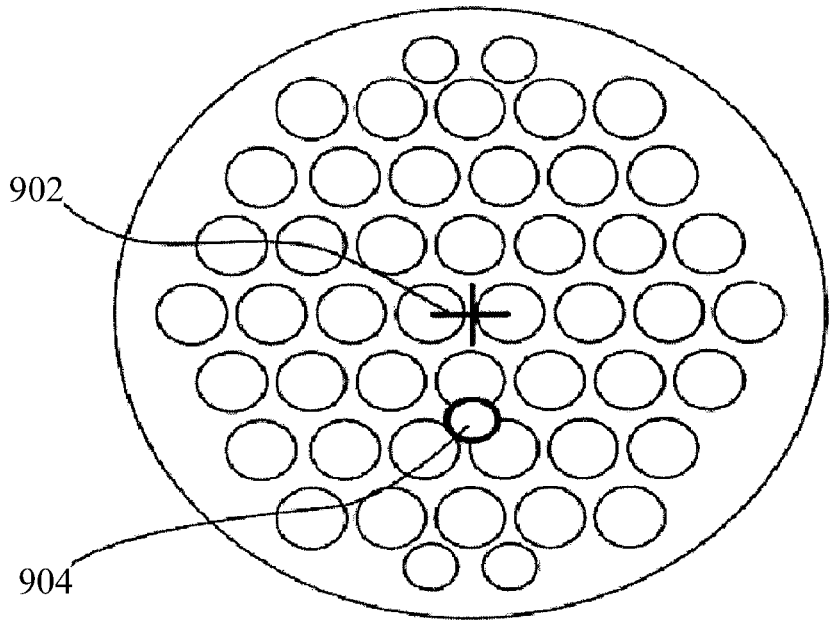
FIG. 18B is a frontal view of a protuberance suitable for use on a footwear, according to embodiments of the present invention.

FIG. 18B is a frontal view of a protuberance suitable for use on a footwear, according to embodiments of the present invention. The peak surface is marked by cross 902. Bore 904 is provided for a screw or other fastening arrangement to fix the protuberance in the desired position.

Figure 18C:
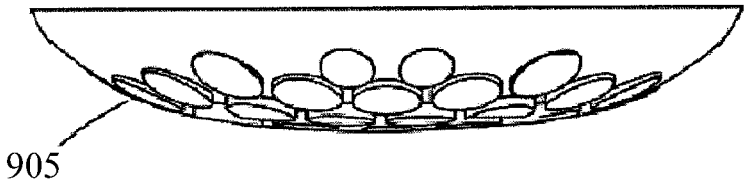
FIG. 18C is a side view of a protuberance suitable for use on a footwear, according to embodiments of the present invention.

FIG. 18C is a side view of a protuberance suitable for use on a footwear, according to embodiments of the present invention. Convexity 905 of the protuberance is clearly seen. Various convexities may be employed, all of which define a peak surface, typically (but not necessarily) at the center of the protuberance, which is the surface which comes in contact with the ground, when the user attaches the support member to the foot, and walks or stands on the ground.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A footwear comprising a support member having an upper surface attachable to a foot, and two bulbous protuberances, a forward bulbous protuberance and rearward bulbous protuberance, each has a curved outer contour, protruding from a lower surface of said support member on opposite sides of a latitudinal midline thereof, said latitudinal midline being halfway between a calcaneus support portion and a phalanges support portion of said support member, wherein the forward bulbous protuberance is positioned laterally offset with respect to a longitudinal centerline, wherein at least one of said protuberances is slidingly mounted on a lower surface of said support member, said footwear is adapted to support the foot only by said two bulbous protuberances when said two protuberances are placed on a ground surface.

2. The footwear as claimed in claim 1, wherein the rearward bulbous protuberance is positioned medially offset with respect to the longitudinal centerline.

3. The footwear as claimed in claim 1, wherein the height of the forward bulbous protuberance is greater than the height of the rearward bulbous protuberance.

4. The footwear as claimed in claim 1, wherein the height of the rearward bulbous protuberance is greater than the height of the forward bulbous protuberance.

5. The footwear as claimed in claim 1, wherein the forward bulbous protuberance, the rearward bulbous protuberance, or both comprise cleats.

* * * * *